US009273476B2

(12) United States Patent
Hoyle

(10) Patent No.: US 9,273,476 B2
(45) Date of Patent: Mar. 1, 2016

(54) MODULAR VOID FORM

(71) Applicant: Terry Hoyle, Denver, CO (US)

(72) Inventor: Terry Hoyle, Denver, CO (US)

( * ) Notice: Subject to any disclaimer, the term of this patent is extended or adjusted under 35 U.S.C. 154(b) by 0 days.

(21) Appl. No.: 14/409,666

(22) PCT Filed: Jun. 18, 2013

(86) PCT No.: PCT/US2013/046244

§ 371 (c)(1),
(2) Date: Dec. 19, 2014

(87) PCT Pub. No.: WO2013/192141

PCT Pub. Date: Dec. 27, 2013

(65) Prior Publication Data

US 2015/0191921 A1 Jul. 9, 2015

Related U.S. Application Data

(60) Provisional application No. 61/661,732, filed on Jun. 19, 2012.

(51) Int. Cl.

| | |
|---|---|
| ***E04G 15/06*** | (2006.01) |
| ***E04G 9/00*** | (2006.01) |
| ***B28B 7/34*** | (2006.01) |
| ***E04G 9/08*** | (2006.01) |
| ***B28B 23/00*** | (2006.01) |
| ***E04G 9/02*** | (2006.01) |

(52) U.S. Cl.
CPC . *E04G 9/00* (2013.01); *B28B 7/342* (2013.01); *B28B 23/0068* (2013.01); *E04G 9/021* (2013.01); *E04G 9/083* (2013.01); *E04G 9/086* (2013.01); *E04G 15/061* (2013.01)

(58) Field of Classification Search
CPC ..... E04G 9/021; E04G 9/083; E04G 9/086; E04G 15/061; B65D 5/0281; B28B 7/342; B28B 23/0068
USPC ..... 249/1, 2, 13, 142, 175
See application file for complete search history.

(56) References Cited

U.S. PATENT DOCUMENTS

| | | | | | |
|---|---|---|---|---|---|
| 1,892,311 | A | | 12/1932 | MacDonald | |
| 1,994,541 | A | * | 3/1935 | Spiking | B65D 5/02 229/103.2 |
| 2,192,183 | A | * | 3/1940 | Deutsch | B28B 7/28 249/DIG. 2 |
| 2,450,941 | A | * | 10/1948 | Crane | B65D 5/02 229/120.04 |
| 2,663,490 | A | * | 12/1953 | Etra | B65D 5/02 229/120.03 |
| 3,024,513 | A | | 3/1962 | Shuxteau et al. | |
| 3,358,960 | A | * | 12/1967 | Oliver | B28B 23/0068 249/175 |
| 3,451,184 | A | * | 6/1969 | Stewart | B28B 23/0068 52/577 |
| 3,512,747 | A | | 5/1970 | Stark | |
| 3,549,116 | A | | 12/1970 | Ferry | |

(Continued)

FOREIGN PATENT DOCUMENTS

| | | |
|---|---|---|
| JP | 11-042625 | 2/1999 |
| KR | 10-0879336 | 1/2009 |

*Primary Examiner* — Michael Safavi
(74) *Attorney, Agent, or Firm* — Leyendecker & Lemire, LLC

(57) ABSTRACT

A modular void form is described. Embodiments of the modular void form can include a panel and at least one reinforcement member. The panel can include one or more scoring lines which the panel can be folded about. When the panel is folded, a tubular structure having a flange can be formed. The panel can include a plurality of slits that form slots when the panel is folded. The reinforcement members can be adapted to be removably inserted into the slots of the panel and engage the flange of the folded panel.

20 Claims, 9 Drawing Sheets

(56) References Cited

U.S. PATENT DOCUMENTS

| | | | | |
|---|---|---|---|---|
| 3,695,574 | A | 10/1972 | Charlier | |
| 4,023,766 | A | 5/1977 | Lubov | |
| 4,685,267 | A | 8/1987 | Workman | |
| 5,102,272 | A | 4/1992 | Woods | |
| 5,531,165 | A | 7/1996 | Taravella | |
| 5,782,049 | A * | 7/1998 | Gates | E04G 15/061 249/10 |
| 5,799,455 | A * | 9/1998 | Gates | E04G 9/08 428/182 |
| 6,050,043 | A | 4/2000 | Rosenblat | |
| 6,116,568 | A | 9/2000 | Rosenblat et al. | |
| 6,794,017 | B2 | 9/2004 | Comeau et al. | |
| 7,243,898 | B2 | 7/2007 | McLean | |
| 7,290,750 | B2 | 11/2007 | Huber | |
| 7,353,641 | B2 | 4/2008 | Yoshii | |
| 7,824,598 | B1 | 11/2010 | Kim | |
| 7,981,330 | B2 | 7/2011 | Jensen | |
| 2005/0011152 | A1 | 1/2005 | O'Grady | |
| 2006/0016150 | A1 | 1/2006 | Fournier | |
| 2007/0194205 | A1 | 8/2007 | Blackmon | |
| 2012/0297701 | A1 | 11/2012 | Oakley | |

* cited by examiner

MODULAR VOID FORM

CROSS-REFERENCE TO RELATED APPLICATION

This application claims the benefit of U.S. Provisional Application No. 61/661,732, filed 19 Jun. 2012.

BACKGROUND

In one application, void forms can be used as space filling members when preparing concrete formations. Void forms generally reduce concrete requirements on construction jobs and allow concrete formations to be built on unstable soil. Void forms are required to be sufficiently strong to withstand the initial weight of poured concrete. In some instances, the void form needs to be degradable to leave a void space. In other instances, the void form needs to be able to withstand degradation.

Currently, most void forms are prefabricated remotely from a building site in predetermined shapes and sizes. Thus, in instances where the job requires a non-standard sized void form, the builder must manually alter the prefabricated void form. Manually altering prefabricated void forms usually increases time and money spent.

To cut down on costs, most void forms are fabricated from corrugated fiberboard. As such, the corrugated fiberboard must have sufficient structural integrity to support wet concrete for a prescribed period of time. Most corrugated fiberboard forms will then weaken through moisture absorption. However, if there is insufficient moisture, the corrugated fiberboard can be preserved and not degrade. Problems arise when the corrugated fiberboard does not degrade and leave a void where a non-structural void is needed.

In another application, void forms can be implemented as dunnage in the shipping industry. Typically, a packaging material is placed in a shipping container to fill any voids and/or to cushion items during shipping. Some commonly used packaging materials include plastic foam peanuts and plastic bubble pack. While these conventional plastic materials seem to perform adequately as cushioning products, they are not without disadvantages. Specifically, plastic bubble wrap and/or plastic foam peanuts are not biodegradable. The non-biodegradability of these packaging materials has become increasingly important in light of many industries adopting more progressive policies in terms of environmental responsibility.

Regardless of application, a void form being durable, adjustable, biodegradable, modular, and cost effective is needed.

DETAILED DESCRIPTION

Figure 1:
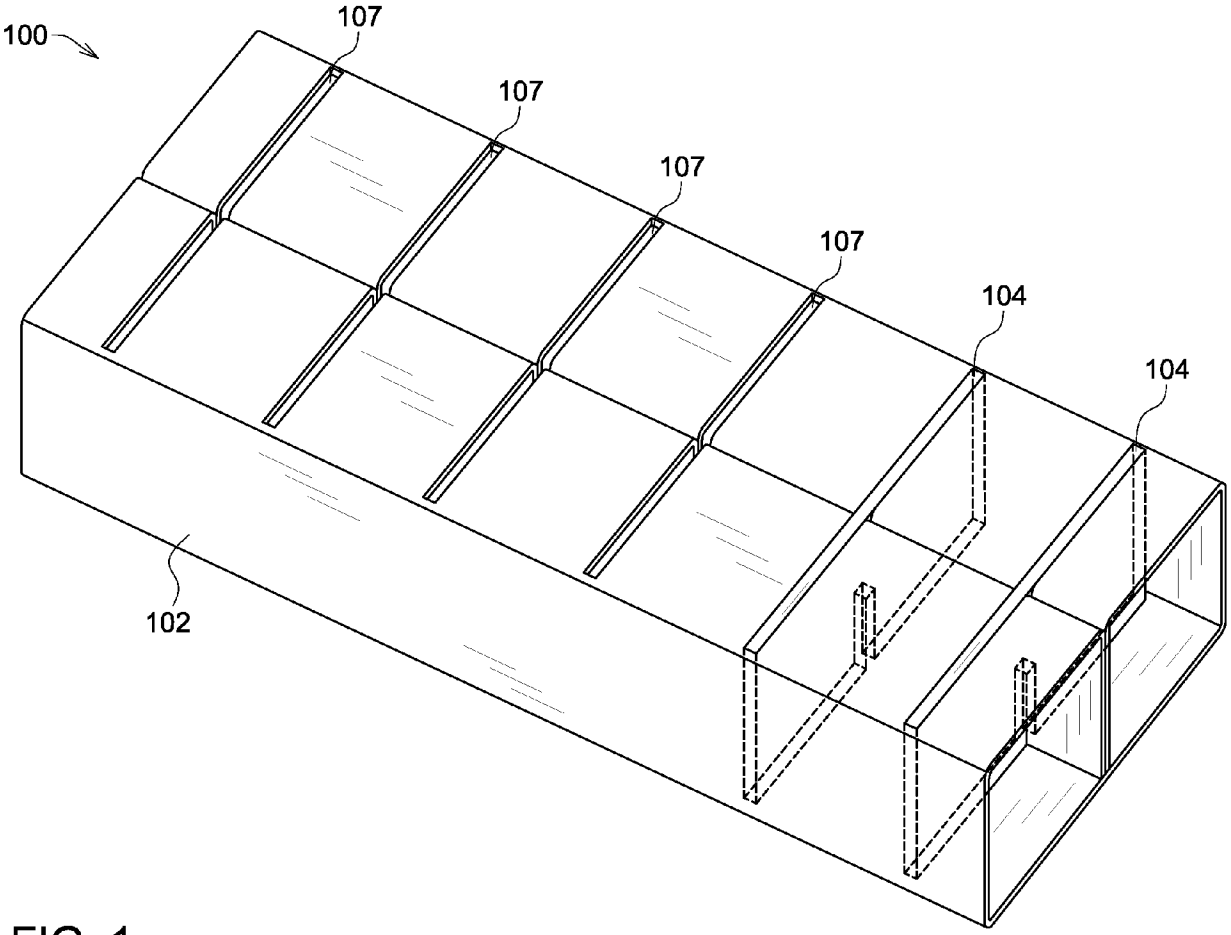
FIG. 1 is a perspective view of a void form according to one embodiment of the present invention.

Embodiments of the present invention include a modular void form adaptable for a variety of applications. The modular void form can be made from a plurality of materials including, but not limited to, corrugated fiberboard, plastic, and metal. In some embodiments, the modular void form can be comprised of more than one material. For instance, a main portion of the void form can be metal and another portion can be comprised of plastic. It is to be appreciated that different portions of the void form can comprise different materials. In one embodiment, the disclosed void form can be implemented to accommodate soil expansion. In such an embodiment, the implementation of materials including, but not limited to, corrugated paper and fiberboard that degrade on contact with environmental moisture can be used.

One embodiment of the void form can include a panel and one or more reinforcement members. The panel generally includes a plurality of slits. The panel can be configured such that when folded, the plurality of slits form slots adapted to receive the reinforcement members. Depending on an implementation, the panel can be folded into a variety of shapes. It is to be appreciated that void forms made from non-pliable materials can implement hinged joints. In one embodiment, the panel can have a rectangular tube shape when folded. Generally, the void form can be transported in a knocked down configuration.

Reinforcement members can be implemented in a variety of different configurations. Some reinforcement members can be used to couple void forms together. Other reinforcement members can be adapted to provide structural integrity. A spanning reinforcement member can provide a smooth exterior surface. In some embodiments, multiple types of reinforcement members can be implemented with a void form. For instance, regular reinforcement members can be implemented in addition to spanning reinforcement members. Structural features of the presently disclosed void form can allow a modular scheme having standard dimensions between slots and between slots and ends of the void form. As such, various types of reinforcement members, cover panels, spanners, end panels, and combinations thereof can have dimensions allowing for interchangeability between different types of reinforcement members.

Some embodiments of the invention include a degradation system. Generally, the degradation system can include a reinforcement member with a pair of notches each adapted to interface with a tube. In one embodiment, the tubing can be adapted to bring water to an interior and/or exterior of the void form to aid in degradation of the void form. For instance, the tubing can be drip line tubing. A water source can be connected to the tubing. In some embodiments, the tubing can also be degradable.

In some embodiments, various components of the void form can be constructed and/or treated to resist moisture and other degradation. Alternatively, various components of the void form can be constructed and/or treated to attract moisture. For instance, a void form can be implemented with degradable water bags, or other timed means of supplying moisture into an interior of the void form. It is to be appreciated that other degrading conditions can be introduced into the interior of the void form.

In one embodiment, a water resistant wrap or coating adapted to resist rain and other environmental moisture can be implemented. For example, to resist moisture, a water resistant film can be implemented over, under, or around a void form. In some embodiments, the water resistant film can be implemented in lieu of a moisture resistant treatment. In another instance, the water resistant film can be used in conjunction with an integrated moisture resistant treatment.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Void Form

Referring to FIG. 1, a detailed a diagram of an embodiment 100 showing a void form according to one embodiment of the present invention is illustrated. In one embodiment, the void form 100 can be implemented to create a void in or adjacent to a concrete cast formation. In another embodiment, the void form 100 can be implemented as dunnage to fill space in a shipping container. It is to be appreciated that the void form 100 can be implemented in a variety of applications where a void space needs to be created and/or where a void space needs to be filled.

As shown, the void form 100 can have a substantially rectangular tube shape. It is to be appreciated that the void form 100 can be implemented in a variety of shapes and sizes. For instance, the void form 100 can have a substantially triangular tube shape.

Figure 2:
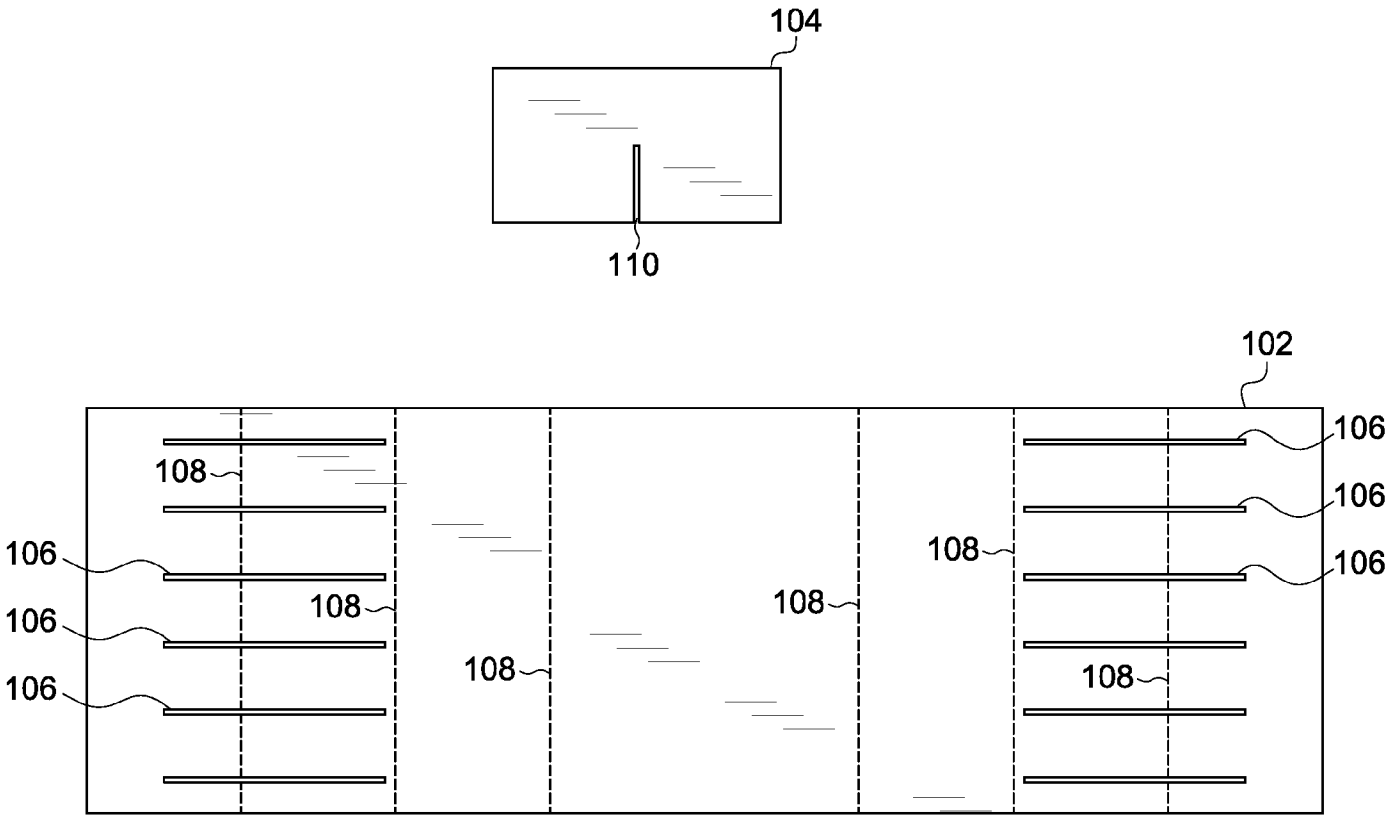
FIG. 2 is a top view of a void form panel and reinforcement member according to one embodiment of the present invention.

Referring to FIG. 2, a detailed diagram of the void form 100 pre-assembly is illustrated. As shown, the void form 100 can include a panel 102 and at least one member 104. As shown, the panel 102 has a substantially rectangular shape. It is to be appreciated that the panel 102 can have a variety of shapes including, but not limited to, rectangular, triangular, and trapezoidal.

In one embodiment, the panel 102 and the member 104 can be comprised of corrugated fiberboard. For example, the panel 102 and the member 104 can be comprised of cardboard. In another embodiment, the panel 102 and the member 104 can be comprised of a polymer. For instance, the polymer can include, but is not limited to, polypropylene, polyvinylchloride, high-density polyethylene, acrylonitrile butadiene styrene, acrylate polymers, polymer films, and corrugated plastic. In yet another embodiment, the panel 102 and the member 104 can be comprised of a metal. For instance, the metal can include, but is not limited to, sheet metal, plate steel, tin sheet, and corrugated metal sheets. It is to be appreciated that the panel 102 and the member 104 can be comprised of a variety of materials. For instance, the panel 102 and the member 104 can be comprised of hardboard and/or hardwood. In some embodiments, the panel 102 can be comprised of a first material and the member 104 can be comprised of a second material. For instance, the panel 102 can be comprised of corrugated fiberboard and the member 104 can be comprised of a polymer.

Generally, the panel 102 can include a plurality of holes 106 and a plurality of scores 108. As shown, each of the plurality of holes 106 has a substantially rectangular shape. It is to be appreciated that a shape and size of the plurality of holes 106 can be based on dimensions of the panel 102.

In one embodiment, the plurality of holes 106 can be slits. Generally, the plurality of slits 106 can be located approximate a left end and a right end of the panel 102. For instance, a first set of the plurality of slits 106 can be located approximate the left end of the panel 102 and a second set of the plurality of slits 106 can be located approximate the right end of the panel 102. Generally, the slits 106 can be sized based on a length of the panel 102 and a thickness of the member 104. In one embodiment, the number of slits 106 can be based on a width of the panel 102. As shown in FIG. 1, when the panel 102 is folded, the slits 106 can form a plurality of slots 107. The slots 107 can be adapted to receive the member 104.

As shown in FIG. 2, the slits 106 are generally parallel with one another. In one embodiment, the plurality of slits 106 can be spaced equidistant from each other. For example, each of the slits 106 can be spaced four inches apart from one another. Generally, the spacing of the slits 106 can be determined based on a width of the panel 102 and a total number of slits 106 to be included. It is to be appreciated that the number of slits can vary from implementation to implementation of the present invention.

In one embodiment, slits located approximate a top of the panel 102 and a bottom of the panel 102 can be spaced half the distance of two regularly spaced slits from the top and bottom edge of the panel, respectively. As such, when two panels are placed in series, the distance between a slit located approximate the top edge of one panel and approximate the bottom edge of another panel will be the same as two regularly spaced slits.

The scores 108 can be adapted to be folding scores. Generally, the folding scores 108 can determine a shape and dimension of the void form 100. In one embodiment, as shown in FIG. 2, the panel 102 can include six folding scores. A folding score can be located approximate a midpoint of each set of slits 106 and near an interior end of each set of slits 106. The remaining pair of folding scores can be located approximate a midpoint of the panel 102. Generally, a user can fold the panel 102 approximate the folding scores 108. It is to be appreciated that the number of folding scores 108 can be adjusted based on a shape and size of the panel 102.

In one embodiment, the member 104 can be a reinforcement member. The reinforcement member 104 can be implemented to support the void form 100. As shown in FIG. 2, the reinforcement member 104 generally has a rectangular shape. The reinforcement member 104 can include a slot 110 adapted to engage the panel 102. As shown in FIG. 1, the reinforcement member 104 can sit flush within one of the member slots 107.

Figure 3A:
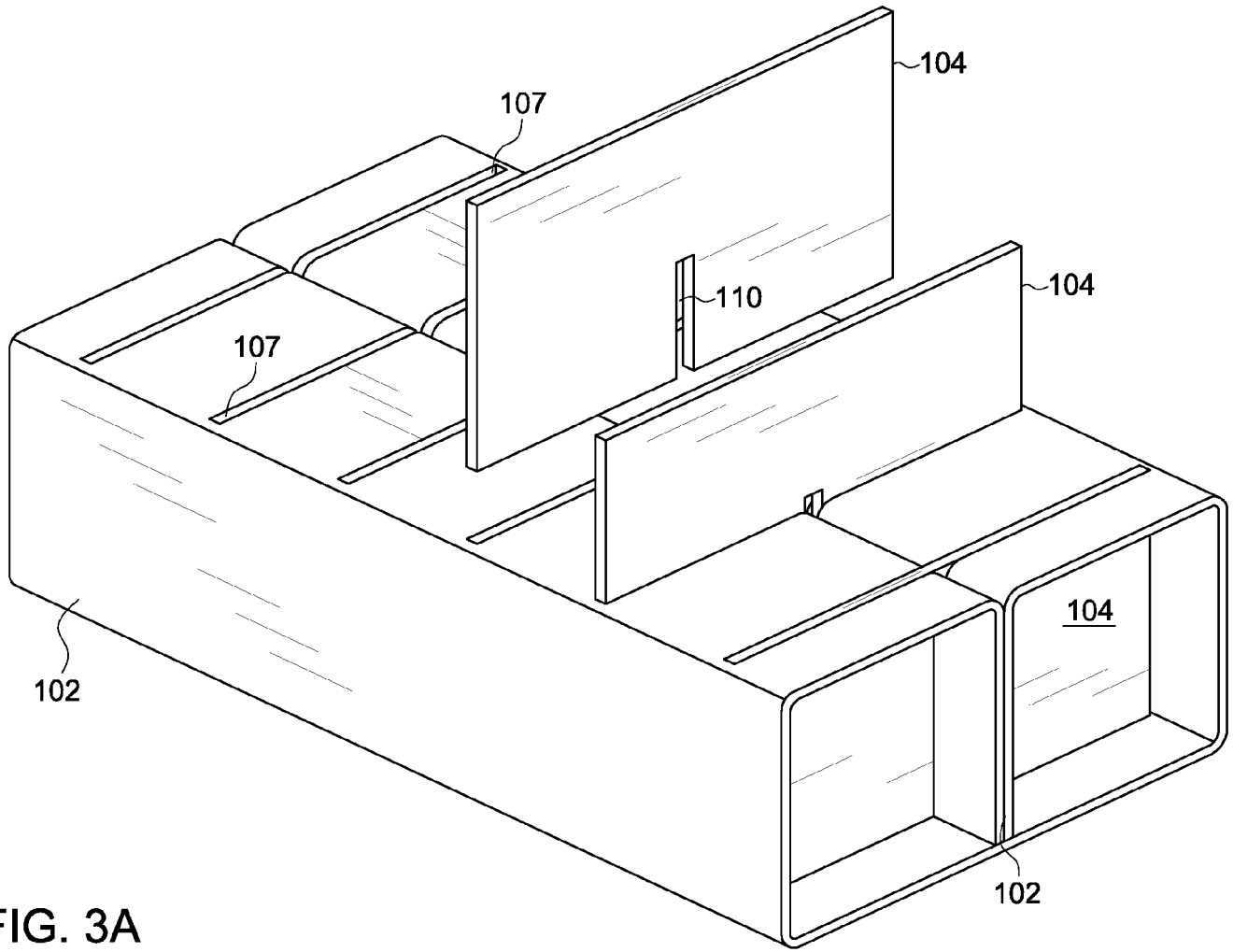
FIG. 3A is a perspective, front view of a void form according to one embodiment of the present invention.
Figure 3B:
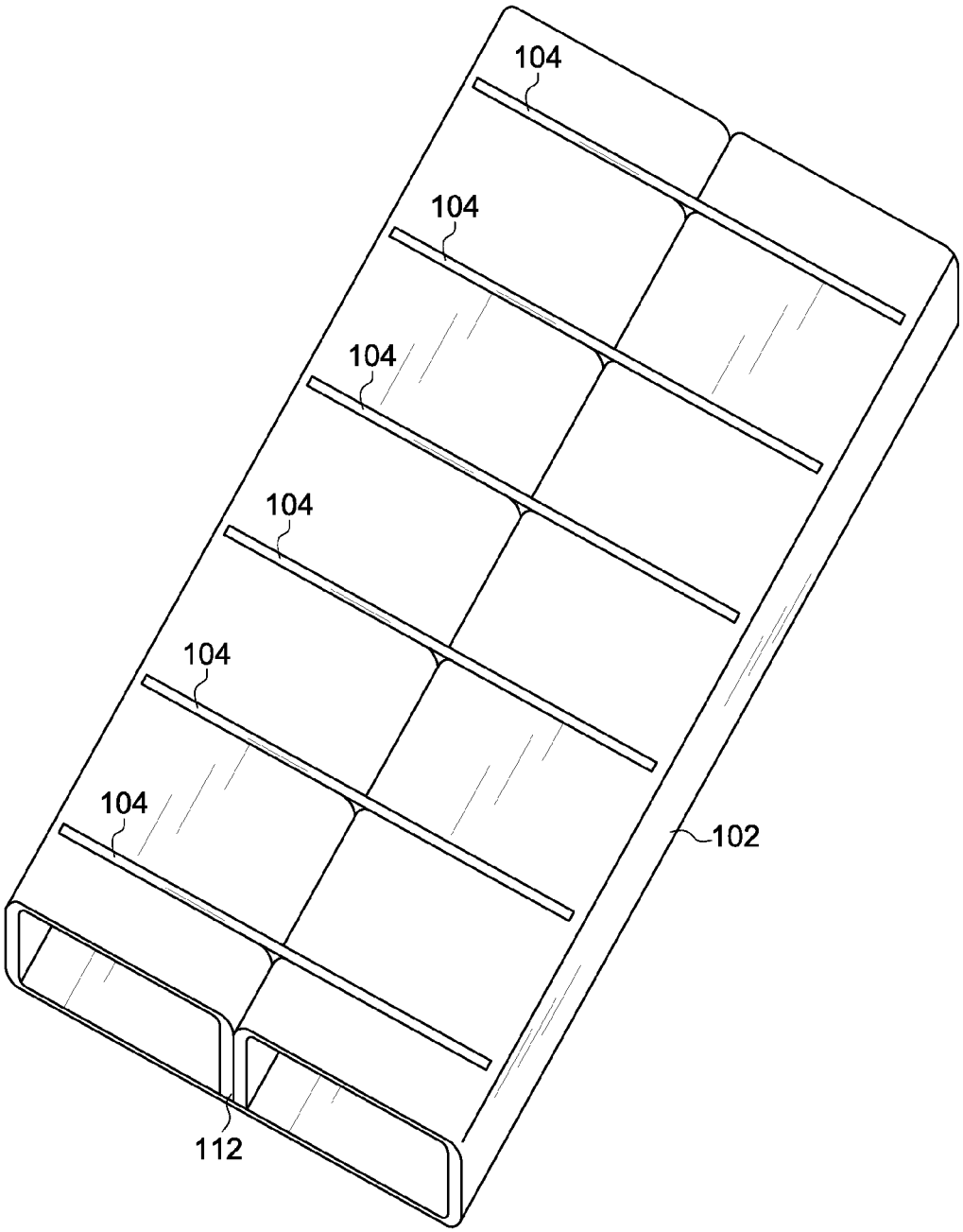
FIG. 3B is a perspective, top view of a void form according to one embodiment of the present invention

Referring to FIGS. 3A-3B, detailed diagrams illustrating reinforcement members 104 being inserted into the folded panel 102 are shown.

As shown in FIG. 3A, after the panel 102 has been folded, the plurality of slits 106 can form the member slots 107. Generally, a left end and a right end of the panel 102 can form a flange 112 when the panel 102 is folded. For instance, the flange 112 can be formed by ends of the panel 102 that can be adjacent to one another when the panel 102 is folded. The flange 112 can provide structural reinforcement of the void form 100 and can be adapted to engage the slot 110 of the reinforcement member 104. It is to be appreciated that a size of the flange 112 can be altered based on a location of the slits 106 on the panel 102. For instance, when the slits 106 are placed towards an inner portion of the panel 102, the flange 112 can have a larger size than when the slits 106 are placed towards ends of the panel 102. In one embodiment, a size of the slot 110 of the reinforcement member 104 can be based on a size of the flange 112.

As shown in FIG. 3A, the reinforcement member 104 can be adapted to insert into the member slots 107 after the panel 102 has been folded. The slot 110 of the reinforcement member 104 can engage the flange 112 created by the panel 102 once the panel 102 has been folded into a rectangular tube. Generally, a size of the slot 110 will correlate with a size of the flange 112. In one embodiment, the reinforcement member 104 can be adapted to snugly engage the flange 112. More specifically, the slot 110 can be adapted to snugly engage the flange 112. In some embodiments, the reinforcement member 104 can be adapted to lock the panel 102 in a folded shape.

A void form with a plurality of reinforcement members 104 inserted is shown in FIG. 3B. As shown, the reinforcement members 104 can be inserted into each of the member slots 107 of the void form 100. It is to be appreciated that the void form 100 can include at least one reinforcement member 104 and as many as will fill each member slot 107 of the void form 100.

Figure 4:
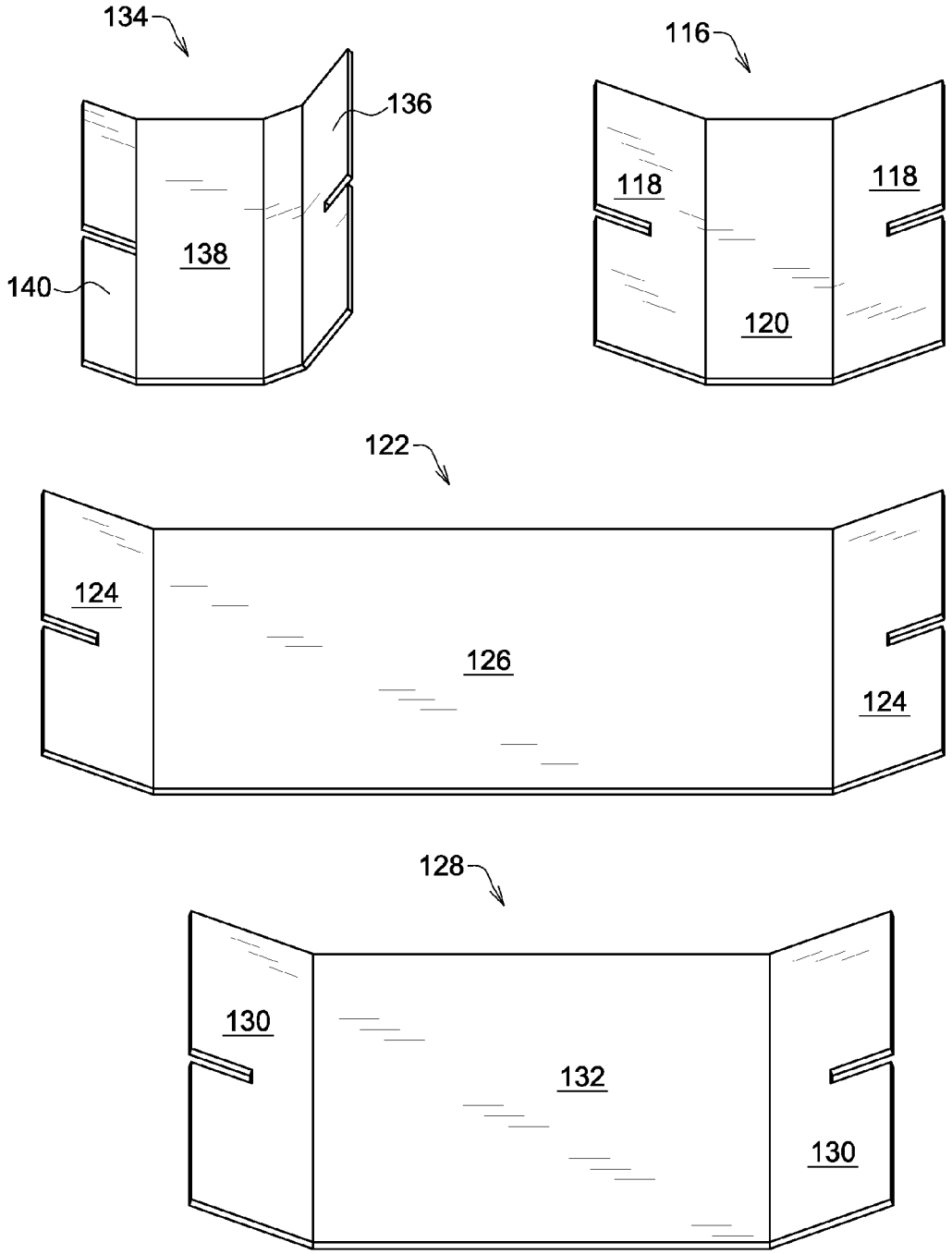
FIG. 4 is a top view of a plurality of reinforcement members according to one embodiment of the present invention.

Referring to FIG. 4, a plurality of reinforcement members are illustrated. As shown, a first top cover 116, a second top cover 122, a third top cover 128, and an end panel 134 are illustrated. In one embodiment, each of the top covers 116, 122, and 128 can be implemented as combination covers. Generally, a combination cover can include at least one reinforcement member and a panel.

The first top cover 116 can be implemented as a single combination cover. As shown in FIG. 4, the single combination cover 116 can include two reinforcement members 118 and a panel 120 adapted to span a distance between two member slots. The single combination cover 116 can combine the functionality of two basic reinforcement members 104 and a panel. In one embodiment, the void form 100 can include a plurality of single combination covers 116 to fill each member slot 107. In another embodiment, the void form can include a plurality of reinforcement members 104 and a plurality of single combination covers 116 to fill each member slot 107 of the void form 100.

For instances where point loading is not expected and protective covers are not needed, the single combination cover 116 can be implemented to couple void forms end-to-end. For example, multiple void forms can be implemented in void areas being long and narrow with low weight retaining needs. In one embodiment, combination covers can be manufactured to be off-set and/or oversized to cover seams between coupled void forms. It is to be appreciated that each of the member slots 107 can receive more than one reinforcement member.

The second top cover 122 can be implemented as a long spanning combination. For instance, the long combination cover 122 can generally span a distance between five slits of the panel 102. The long combination cover 122 can include a pair of reinforcement members 124 and a panel 126. The third top cover 128 can be implemented as a short spanning combination. For instance, the short combination cover 128 can span a distance between three slits of the panel 102. The short combination cover can include a pair of reinforcement members 130 and a panel 132. It is to be appreciated that a combination of reinforcement members, top covers, and protective covers can be implemented with the previously described void form 100. For example, a plurality of reinforcement members 104 can be combined with a long combination cover 122 to fill each of the member slots of a void form. Protective covers can include, but are not limited to, water resistant sheets, plastic sheets, and puncture resistant panels. Puncture resistant panels can include, but are not limited to, hardboard and hardwood.

The end panel 134 can be adapted to close one end of a void form. Generally, the end panel 134 can include a reinforcement member 136, a panel 138, and a member 140. The reinforcement member portion 136 can be adapted to engage a flange of the void form similar to the reinforcement member 104 previously described. The panel 138 can be adapted to close an end of the void form. The member 140 can be adapted to engage a bottom portion of the flange.

Figure 5:
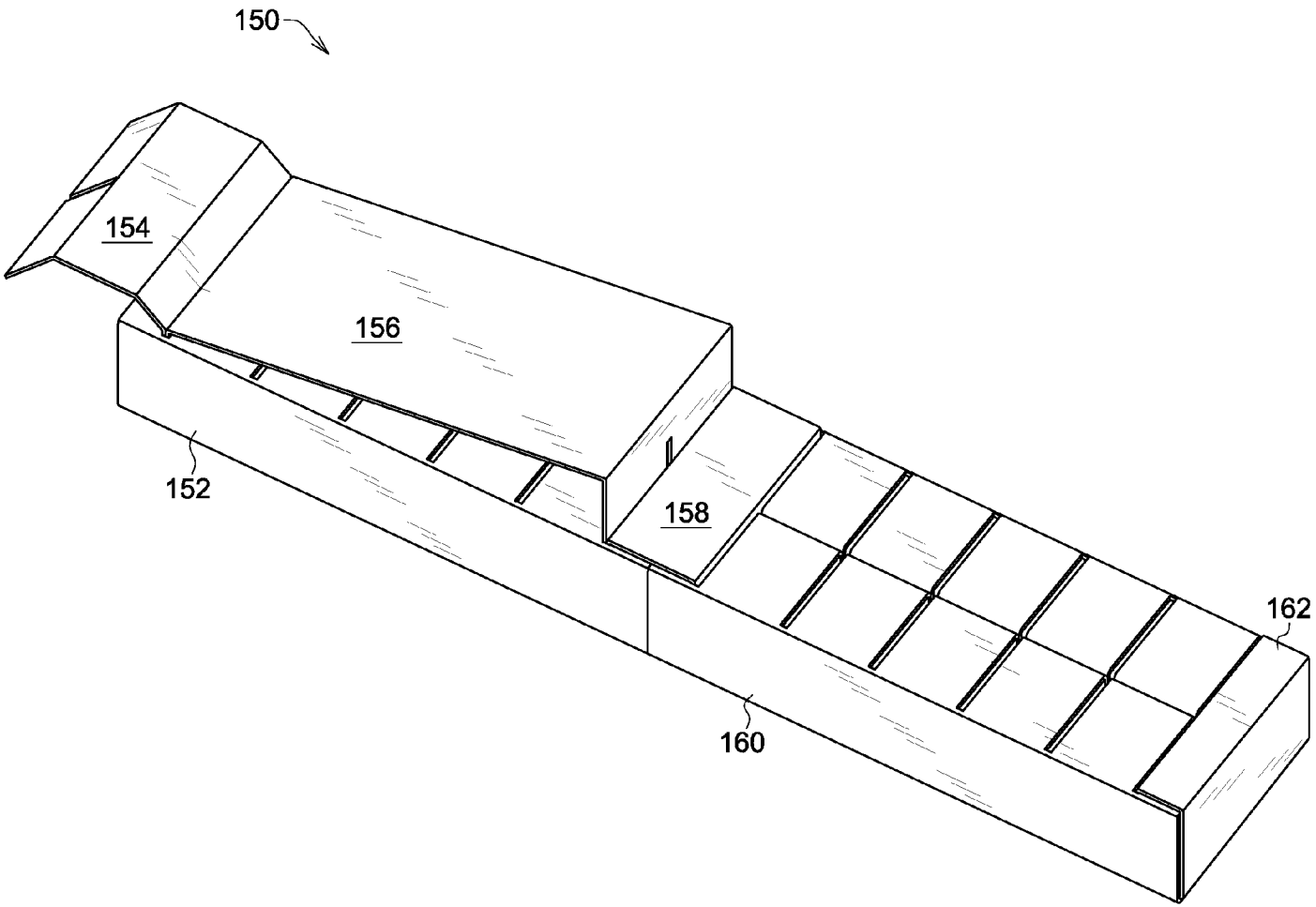
FIG. 5 is a perspective view of a pair of void forms according to one embodiment of the present invention.

Referring to FIG. 5, a detailed diagram of a combined void form 150 is illustrated. As shown in FIG. 5, a void form 152 can include a plurality of different reinforcement members. As shown, an end panel 154 can be implemented at one end of the void form 152. Generally, the end panel 154 can be inserted into an end member slot of the void form 152. A long combination cover 156 can be implemented to cover a majority of the void form 152. In one embodiment, a plurality of reinforcement members can be inserted into member slots of the void form 152 under the long combination cover 156. A single combination cover 158 can be implemented to couple the void form 150 to a void form 160. In one embodiment, the void form 160 can include an end panel 162. As shown, the end panel 162 can close an end of the void form 160. Further shown in FIG. 5, each of the member slots can be adapted to receive more than one reinforcement member. The long combination cover 156 and the single combination cover 158 share a member slot.

Figure 6:
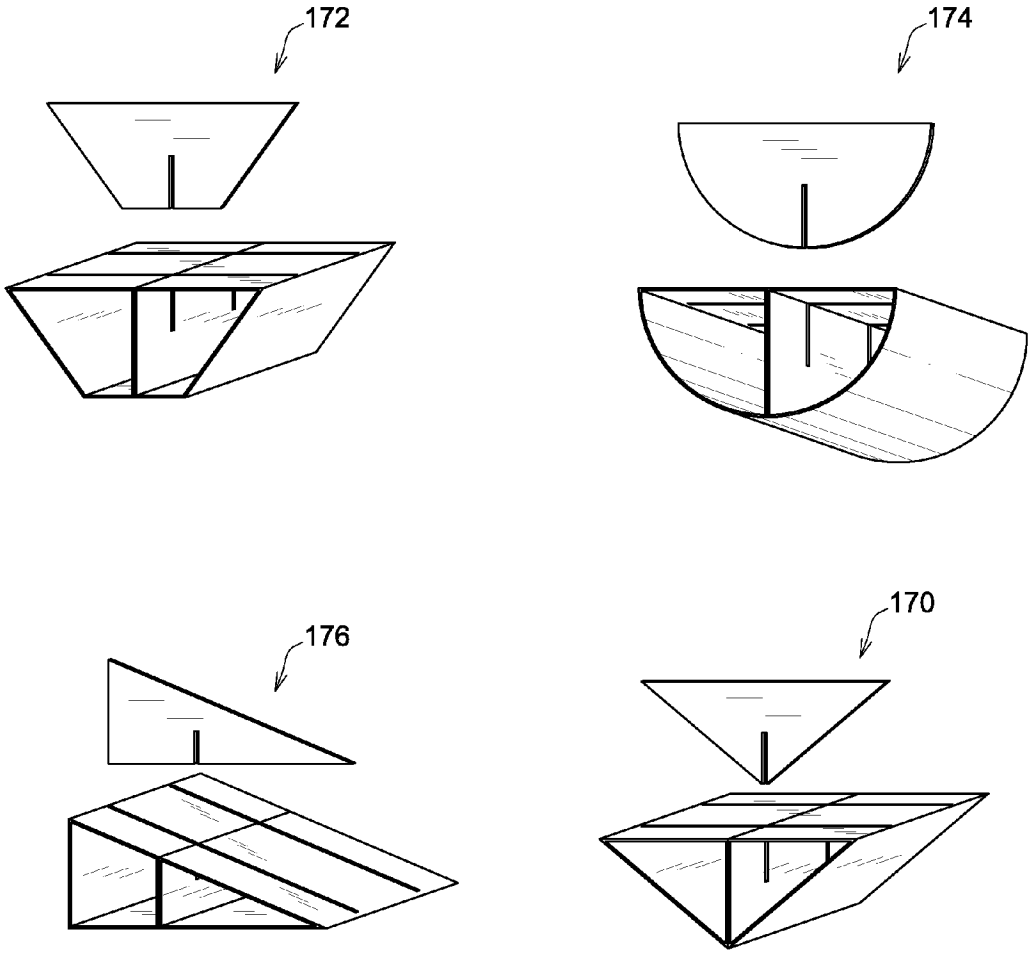
FIG. 6 is detailed diagram of a plurality of void forms according to one embodiment of the present invention.

Referring to FIG. 6, a detailed diagram of a plurality of differently shaped void forms is illustrated. Reinforcement members are also illustrated for each void form shape. A triangular shaped void form 170, a trapezoidal shaped void form 172, an arched or semi-circle shaped void form 174, and a triangular shaped void form 176 are shown.

In one embodiment, the arched void form 174 can be implemented to cast a protective panel integrally within a casting to act as a retainer and protect a void space. In an embodiment, the arched void form 174 can be stacked atop the trapezoidal void form 172 to provide more volume of void space while providing a partial protection/retainer panel. It is to be appreciated that a variety of differently shaped void forms can be implemented together.

Generally, the void form 100 illustrated in FIG. 1 can include a panel, similar to the panel 102 shown in FIG. 2, adapted for a specific implementation. The panel can be sized and scored to enable folding to a desired shape and dimension. Based on a specific implementation, a quantity and type of reinforcement member can be determined. In one embodiment, a number of slits for the panel can be based on the quantity of reinforcement members needed. Generally, the quantity of reinforcement members can be based on a weight of anticipated loads.

In some embodiments, the number of reinforcements members implemented may not coincide with the number of slits. For instance, in applications with light loads, materials and resultant costs can be saved by implementing fewer reinforcement members. In applications with heavy loads, reinforcement members of greater strength can be implemented and/or the number of reinforcement members can be increased. For instance, reinforcement members comprising a rigid polymer can be implemented. It is to be appreciated that various changes and modifications can be made without departing from the scope of the present invention.

In one embodiment, void forms can be placed in a casting area or mold where a void is needed. Generally, the void form can be sized as appropriate to fill the desired void space. Larger void areas might need a multitude of void forms placed end-to-end and/or side-by-side. In one embodiment, the void forms can be placed end-to-end and side-by-side and stacked upon each other to define a void area. Generally, the void form can be placed with the reinforcement members facing an interior of a void area. With the reinforcement members facing interiorly, a smooth closed surface can define an exterior surface of the void form that can interface with an expected load. In embodiments with various types of reinforcement members implemented, the void form can be placed with the various reinforcement members facing the anticipated load.

In some embodiments, tape can be implemented to seal seams and openings in the void form. In one embodiment, a protective cover can be placed on the void form. For instance, where point loading is possible, a protective cover sheet can be implemented. For example, a rigid polymer sheet or hardboard can be implemented. In one embodiment, a protective cover providing puncture resistance can be implemented with the void form.

A Method of Assembling a Void Form

Figure 7A:
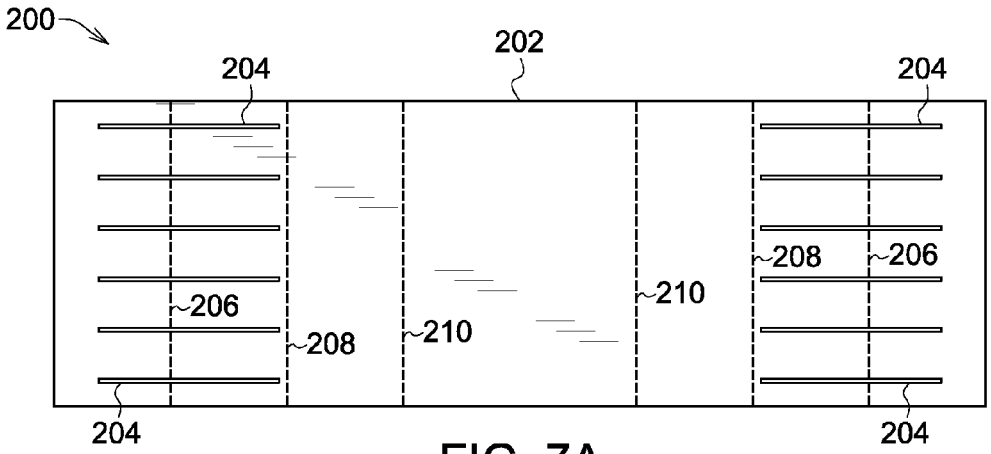
FIGS. 7A-7D are detailed diagrams of how a void form can be folded according to one embodiment of the present invention.

Referring to FIGS. 7A-7D, one example of how a void form 200 can be assembled is illustrated. As shown in FIG. 7A, the void form 200 can include a panel 202. The panel 202 can include a plurality of holes 204 and a pair of scores 206, a pair of scores 208, and a pair of scores 210.

Figure 7B:
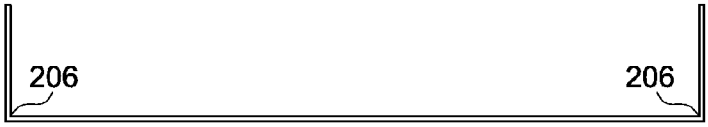
Figure 7C:
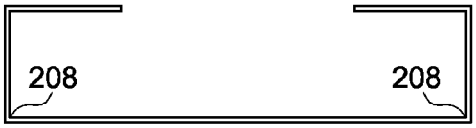
Figure 7D:
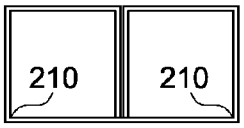

As shown, the panel 202 can have a rectangular shape, and when folded, have a rectangular tube shape, as shown in FIG. 7D. It is to be appreciated that the method of folding the panel 202 can be implemented for a variety of differently shaped panels. The disclosed method of folding the panel 202 is for illustrative purposes only and is not meant to be limiting.

First, the panel 202 can be folded inward about the scores 206 located approximate midpoints of the holes 204, as shown in FIG. 7B. Next, the panel 202 can be folded inwards about the scores 208 located approximate inner ends of the holes 204, as shown in FIG. 7C. Finally, the panel 202 can be folded inwards about the scores 210 located approximate a midpoint of the panel 202, as shown in FIG. 7D. After the panel 202 has been folded, a reinforcement member can be inserted into one of the plurality of holes 204 of the folded panel 202.

A Second Embodiment of a Void Form

Figure 8:
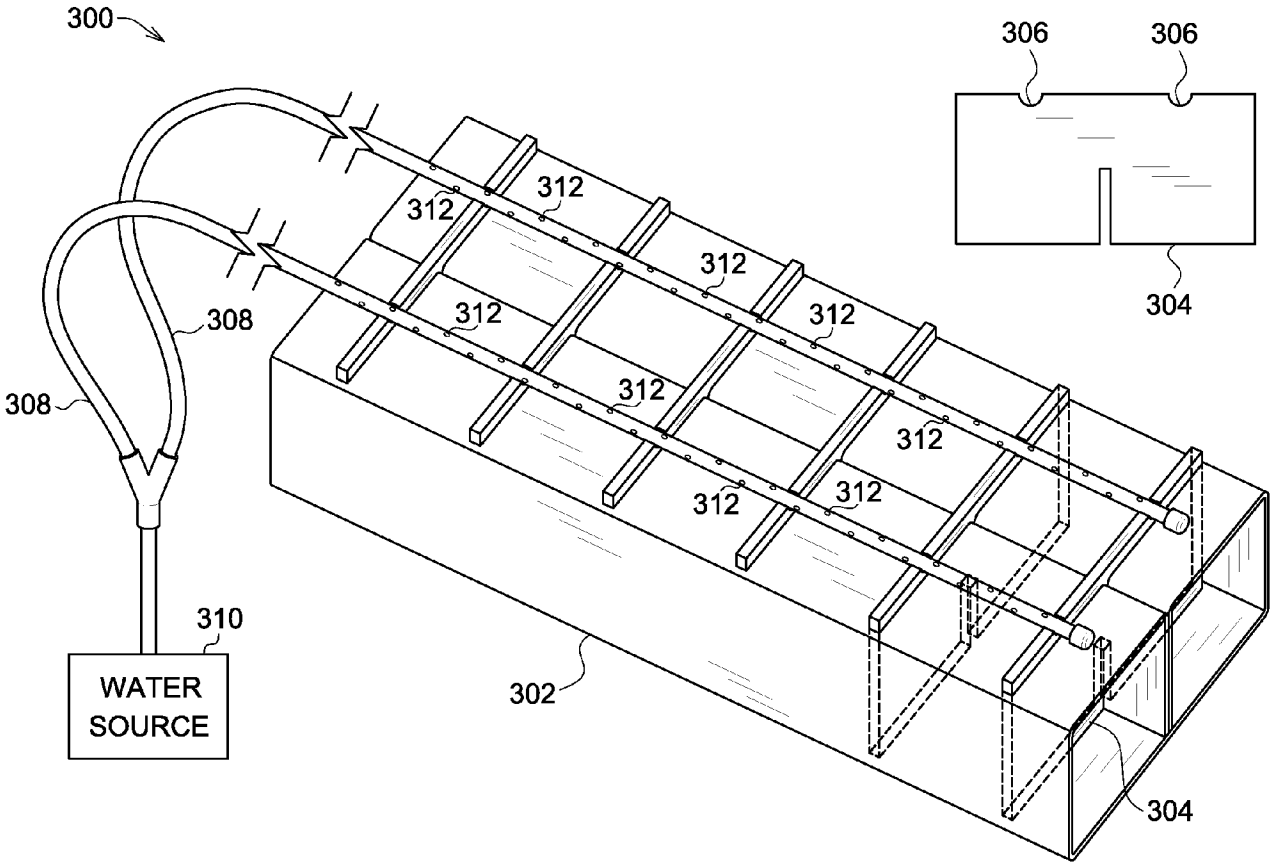
FIG. 8 is a perspective view of a void form according to one embodiment of the present invention.

Referring to FIG. 8, a detailed diagram of an embodiment 300 showing a void form according to one embodiment of the present invention is illustrated. The void form 300 can be implemented to create a void space and/or fill a void space. As shown, the void form 300 has a substantially rectangular tube shape. It is to be appreciated that the void form 300 can be implemented in a variety of shapes and sizes. For instance, the void form 300 can have a substantially triangular tube shape.

As shown in FIG. 8, the void form 300 can include a panel 302 and at least one member 304. Generally, the void form 300 can be similarly constructed to the previously described void form 100.

In one embodiment, the member 304 can be implemented as a reinforcement member. The reinforcement member 304 can be similarly constructed to the reinforcement member 104. The reinforcement member 304 can include a pair of notches 306. Each of the notches 306 can be adapted to interface with and/or secure a tube 308.

In one embodiment, the tube 308 can be adapted to receive water from a water source 310. Generally, the tube 308 can be adapted to receive water and distribute water along a length of the tube 308. For instance, the tube 308 can be a drip line tube. When water is introduced into the tube 308, the water can exit a plurality of orifices 312 of the tube 308 and interface with the void form 300. The water can be introduced to help degrade the void form 300.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A modular void form comprising:

a first rectangular tube structure having a plurality of slots, the first rectangular tube structure formed from a panel having a plurality of slits and a plurality of scoring lines, wherein when the panel is folded about the scoring lines the first rectangular tube structure having a plurality of slots is formed;

a second rectangular tube structure having a plurality of slots, the second rectangular tube structure formed from a second panel having a plurality of slits and a plurality of scoring lines, wherein when the second panel is folded about the scoring lines the second rectangular tube structure having a plurality of slots is formed; and a reinforcement member having a first flange and a second flange adapted to couple the first rectangular tube structure to the second rectangular tube structure, the first flange being inserted into one of the plurality of slots of the first rectangular tube structure and the second flange being inserted into one of the plurality of slots of the second rectangular tube structure.

2. The modular void form of claim 1, the modular void form further comprising:

a third rectangular tube structure having a plurality of slots, the third rectangular tube structure formed from a third panel having a plurality of slits and a plurality of scoring lines, wherein when the third panel is folded about the scoring lines the third rectangular tube structure having a plurality of slots is formed; and a second reinforcement member having a first flange and a second flange adapted to couple the third rectangular tube structure to the second rectangular tube structure, the first flange being inserted into one of the plurality of slots of the third rectangular tube structure and the second flange being inserted into one of the plurality of slots of the second rectangular tube structure.

3. The modular void form of claim 1, wherein each of the plurality of slots of the rectangular tube structures are equidistantly spaced such that a top slot and a bottom slot are spaced half of the equidistant spacing from ends of each of the rectangular tube structures.

4. The modular void form of claim 1, wherein (i) the first panel forms a flange when folded, the flange being formed by ends of the first panel that are adjacent to one another when the first panel is folded and (ii) the second panel forms a flange when folded, the flange being formed by ends of the second panel that are adjacent to one another when the second panel is folded.

5. The modular void form of claim 1, wherein the plurality of slits includes a first set of slits and a second set of slits, the first set of slits being located proximate a left side of the panel and the second set of slits being located proximate a right side of the panel.

6. The modular void form of claim 5, wherein the first set of slits are parallel with one another and the second set of slits are parallel with one another.

7. The modular void form of claim 1, wherein the first panel and the second panel each comprise a material selected from the group consisting of:

a corrugated fiberboard;
a hardboard;
a hardwood;
a metal; and
a polymer.

8. The modular void form of claim 7, wherein the reinforcement member comprises a material selected from the group consisting of:

a corrugated fiberboard;
a hardboard;
a hardwood;
a metal; and
a polymer.

9. A void form system comprising:

a first panel having a plurality of slits and a plurality of scoring lines, wherein when the first panel is folded about the scoring lines a rectangular tube structure having a plurality of slots is formed;

wherein each of the plurality of slots of the first rectangular tube structure are equidistantly spaced such that slots proximate ends of the first rectangular tube structure are spaced half of the equidistant spacing from the ends of the first rectangular tube structure;

a second panel having a plurality of slits and a plurality of scoring lines, wherein when the second panel is folded about the scoring lines a rectangular tube structure having a plurality of slots is formed;

wherein each of the plurality of slots of the second rectangular tube structure are equidistantly spaced such that slots proximate ends of the second rectangular tube structure are spaced half of the equidistant spacing from the ends of the second rectangular tube structure;

at least one reinforcement member removably inserted into one of the plurality of slots of each of the rectangular tube structures; and a single combination cover having a first flange, a second flange, and a panel, the single combination cover coupling the first rectangular tube structure to the second rectangular tube structure.

10. The void form system of claim 9, wherein (i) the first panel forms a flange when folded, the flange being formed by ends of the first panel that are adjacent to one another when the first panel is folded and (ii) the second panel forms a flange when folded, the flange being formed by ends of the second panel that are adjacent to one another when the second panel is folded.

11. The void form system of claim 10, wherein the reinforcement members each have a slot located approximate a middle portion of the reinforcement members.

12. The void form system of claim 11, wherein the slots of the reinforcement members each removably engage the flanges of the rectangular tube structures.

13. A void form comprising:

a panel having a plurality of slits and a plurality of scoring lines, wherein when the panel is folded about the scoring lines a rectangular tube structure having a plurality of slots is formed;

wherein the panel forms a flange when folded, the flange being formed by ends of the panel that are adjacent to one another when the panel is folded;

wherein the plurality of slits includes (i) a first set of slits parallel with one another located proximate a left side of the panel and (ii) a second set of slits parallel with one another located proximate a right side of the panel;

at least one reinforcement member removably inserted into one of the plurality of slots of the rectangular tube structure, the reinforcement member having a slot located approximate a middle portion of the reinforcement member adapted to removably engage the flange of the rectangular tube structure; and at least one spanning member removably inserted into two of the plurality of slots of the rectangular tube structure, the at least one spanning member having a first flange, a second flange, and a panel;

wherein the rectangular tube structure comprises:

a flat bottom surface;
a pair of flat side surfaces; and
a flat top surface, the plurality of slots being located on the top surface;

wherein a top surface of the at least one reinforcement member is flush with the top surface of the rectangular tube structure when inserted into one of the plurality of slots.

14. The void form of claim 13, wherein the reinforcement member has a slot located approximate a middle portion of the reinforcement member.

15. The void form of claim 13, wherein the slot of the reinforcement member removably engages the flange.

16. The void form of claim 13, wherein the void form further comprises an insert selected from the group consisting of:

a single spanning top cover;

a short spanning top cover;

a long spanning top cover; and an end panel.

17. The void form of claim 13, wherein the panel comprises a material selected from the group consisting of:

a corrugated fiberboard;

a hardboard;

a hardwood;

a metal; and a polymer.

18. The void form of claim 17, wherein the reinforcement member comprises a material selected from the group consisting of:

a corrugated fiberboard;

a hardboard;

a hardwood;

a metal; and a polymer.

19. The void form of claim 13, wherein the panel comprises a different material than the reinforcement member.

20. The void form of claim 13, wherein the least one spanning member is puncture resistant.

* * * * *